DIE FOR THE FORMATION OF SEMI-CLOSED CHANNELS OR OTHER COMPLEX CONFIGURATIONS

BACKGROUND OF THE INVENTION

1. Field of the Invention

This invention relates to a new and improved die for the formation of semi-closed channels or other complex configurations in workpieces.

2. Description of the Prior Art

Although dies for the formation of semi-closed channels or other complex configurations in workpieces are known, the same will generally be found to be of relatively complex and expensive design and construction in requiring specialized materials, large numbers of parts, and/or extensive tooling in the fabrication thereof. In addition, many of the prior art dies of this nature will be found lacking in terms of long term reliability in that the same are prone to wear and/or mechanical break-down with resultant high maintenance requirements and attendant frequent periods of totally unproductive down-time. In addition, it is not believed uncommon with regard to many of the prior art dies of this nature to find that, although the same are basically equal to the described task, stretching, surface marring and/or like disadvantageous degradation of the physical properties of the workpiece, and/or bending of the areas of the workpiece adjacent to the configuration of interest, often occur attendant the formation of the latter with the necessity, in many instances, of high rejection rates of the finished products; it being understood by those skilled in this art that this problem would be particularly acute in those instances wherein the workpiece was coated with a material having substantially less resistance to scarring and/or abrasion than the workpiece itself. Also of significant disadvantage with regard to some of the prior art dies of this nature is the fact that the operation thereof is complex and time-consuming, and thus overly costly, in requiring a relatively high level of skill and/or a number of separate steps to achieve the desired end.

OBJECTS OF THE INVENTION

It is, accordingly, an object of our invention to provide a new and improved die for the formation of semi-closed channels or other complex configurations in workpieces which is of simple and inexpensive design and construction.

Another object of our invention is the provision of a die as above which requires the use of only readily available materials of proven dependability in the fabrication thereof to further provide for low cost, and to insure long periods of satisfactory, maintenance-free operation.

Another object of our invention is the provision of a die as above which advantageously functions to form the desired complex configurations in workpieces without any stretching, marring of the surface or surface coating as the case may be, or like degredation in the physical characteristics of the workpiece, and without bending of the adjacent areas of the workpiece.

A further object of our invention is the provision of a die as above which is simple and quick to operate to thus enable advantageously high production rates by relatively unskilled workers, all to significant economic benefit.

A still further object of our invention is the provision of a die as above which, when maintenance is required, can be substantially rebuilt to generally "new" condition by the expedient replacement of a small number of easily pre-fabricated components of a readily available inexpensive material.

DESCRIPTION OF THE DRAWINGS

The above and other objects and advantages of our invention are believed made clear by the following detailed description thereof taken in conjunction with the accompanying drawings wherein:

FIG. 1 is an end elevational view of the components of a new and improved die constructed and operative in accordance with the teachings of our invention and shown in the open position thereof;

FIG. 2 is a side elevational view of the die components of FIG. 1, again in the open position thereof, and includes a portion broken away for purposes of illustration;

DETAILED DESCRIPTION OF THE INVENTION

Figure 4:
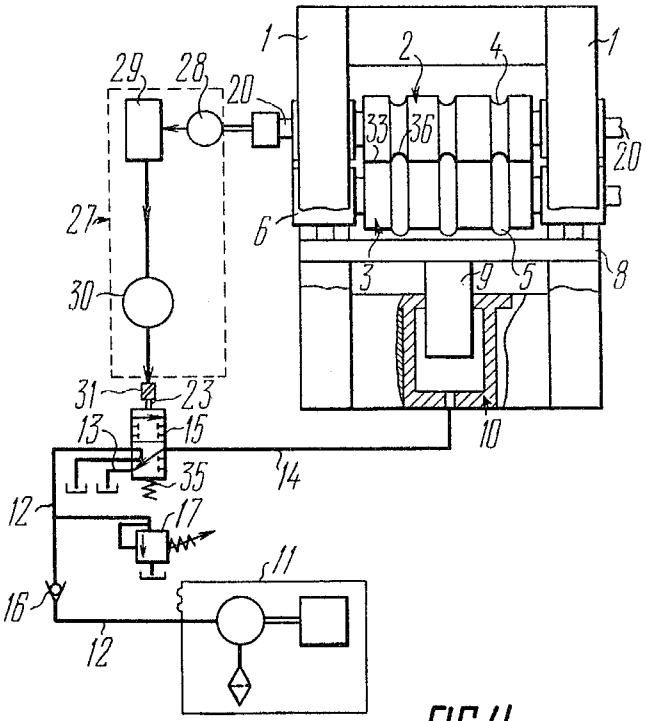
FIG. 4 is a view in the nature of FIG. 3 with the die components in the open position thereof and the now appropriately formed workpiece ready for convenient removal from the die.

Referring now to FIGS. 1 and 2 of the drawings, a new and improved die constructed and operative in accordance with the teachings of our invention for the formation of semi-closed channels or other complex configurations in workpieces is indicated generally at 10; and will be seen to comprise a male die member as indicated generally at 12, and a female die member as indicated generally at 14.

The male die member 12 comprises a generally cross-shaped support member assembly 16 which includes a mounting tang 18, cross-pieces 20 and 22, and neck 24 which terminates as shown in a generally cylindrical or rod-like mandrel 26 which is laterally coextensive therewith. Preferably, the support member assembly 16 is, for example, of mild steel construction, and is fabricated by the appropriate welding, as indicated at 28, of angles 30 and 32 to the neck 24 to form the mounting tang 18 and the cross-pieces 20 and 22; and the appropriate welding, as indicated at 34, of the mandrel 26 to the neck 24; all to result in a functionally integral, inexpensive, and particularly strong support member assembly.

Further included in the male die member 12 are pressure blocks 36 and 38 which are formed of a readily availble, inexpensive and particularly durable elastic material having appropriate characteristics with regard to compressibility and resiliency for purposes described in greater detail hereinbelow; it being noted, for example, that urethane has proven eminently satisfactory in this regard. Side plates are indicated at 44 and 46; and the side plates and pressure blocks are attached to the neck 24 by spaced through-bolt assemblies 40 which extend as shown through generally oblong apertures 42 formed in the neck 24 as seen in the cut away portion of FIG. 2, and through aligned apertures (not shown) formed respectively in the pressure blocks and side plates. The side plates 44 and 46 are disposed as shown

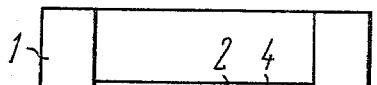
1
2
4

MILL STAND FOR FORMING DISCONTINUOUS LONGITUDINAL DEFORMATIONS IN SHEET METAL

BACKGROUND OF THE INVENTION

Field of the Invention

The present invention relates to metal shaping, and more particularly to a mill stand for forming discontinuous longitudinal deformations on sheet metal.

The term "sheet metal" as used herein refers to a metal strip and the term "longitudinal deformation" refers to forming longitudinally extending deformed portions on the sheet metal in the form of corrugations running parallel at certain intervals from the edges of a strip (i.e. closed corrugations).

The mill stand of the invention is preferably designed to manufacture metal sheet panels having corrugated portions of improved rigidity with flat portions therebetween and along the sheet periphery for convenience in mounting and welding. Such panels are commonly used for manufacturing thin-walled spatial structures, such as railway cars or building metal elements.

Known in the prior art is a shaping mill (U.S. Pat. No. 3,686,917) for impressing discontinuous longitudinal deformations upon sheet metal, which comprises a stand with rolls having circumferential discontinuous congruent forming elements.

The prior art shaping mill is designed to longitudinally deform the sheet metal which is fed into the mill stand. The length of the deformed portions (corrugations) is equal to the arcuate length of the roll forming elements. Thus, should a need arise for changing corrugation lengths, it is required to use another set of rolls with forming elements having arcuate lengths conforming to the length of newly desired corrugations. However, since the maximum length of the deformed portions on the sheet metal is limited by the circumferential length of the forming rolls, any increase in length of the deformed portions may be achieved only through an increase in the forming roll diameters. Therefore, when the corrugation lengths are to be changed, it is necessary to change forming rolls, which calls for re-setting the mill stand and, consequently, additional expenses in preparing and setting up a new set of rolls. In addition, corrugations of increased lengths call for bigger roll diameters, which in turn requires an increased metal consumption and enlarged overall dimensions of the mill stand which is impractical because of its larger size.

Known in the prior art devices which make it possible to produce sheet metal panels with corrugations having a length greater than that of the circumference of the forming rolls.

There is known a method and an apparatus for deforming sheet material (British Pat. No. 1,193,831). The apparatus is a mill stand for longitudinally deforming certain portions on sheet material. The stand comprises a frame member with forming rolls having congruent circumferential forming elements, the number of which corresponds to the number of corrugation to be formed on sheet metal, a power cylinder (pneumatic or hydraulic) connected with one of the forming rolls for a vertical reverse motion of this roll, and a system for feeding a working medium to the power cylinder. This system includes a means (slide valve) for controlling the power cylinder. The stand is also provided with a master device interacting with the means for controlling the power cylinder. The master device is composed of a plurality of proximity limit switches.

When the apparatus described above is in operation, sheet metal in the form of separate strips (blanks) of finite lengths is fed into the forming stand. In passing between the forming rolls, the leading end of the blank is not subjected to deformation but as soon as it approaches the proximity limit switch mounted downstream of the mill stand, there is produced a command for actuating the slide valve to pass the working medium (hydraulic fluid or air) into the power cylinder. A rod of the cylinder moves one of the forming rolls, thereby bringing the forming rolls together. The process of longitudinally deforming blank portions begins, i.e. a number of corrugations parallel to each other are impressed upon the sheet metal. When the corrugations are formed in the blank, the tail end of the blank acts upon another proximity limit switch mounted before the roll axis plane. This is followed by a command for actuating the slide valve to move the hydraulic cylinder upwardly. Thus, the rolls are separated, the deformation process is ceased and the corrugated article with a flat portion at its tail end leaves the clearance between the rolls.

Since the deformation process is started and ceased depending on the position of the leading and tail ends of a blank, the mill stand described above is unsuitable for deforming sheet metal fed thereto in the form of a continuous strip. Therefore, prior to being deformed, metal strip coils are cut into blanks of finite length. In addition, to deliver separate blanks into the mill stand, provisions are made for guiding the leading end of each blank into the clearance between the forming rolls. This leads to decreasing the blank supply rate and, consequently, slows the longitudinal deformation process.

In addition, since the starting and end moments of the deformation process are dependent on the position of the leading and tail ends of a blank of finite length, it is impossible to impress thereupon a plurality of discontinuous longitudinally corrugated portions.

It is, therefore, an object of the invention to provide a mill stand of improved efficiency for forming discontinuous longitudinal deformations on sheet metal.

Another object of the invention is to provide a mill stand which makes it possible to form discontinuous longitudinally extending deformations on sheet metal in the form of a continuous strip continuously fed into the stand.

Yet another object of the invention is to provide a mill stand which makes it possible to form discontinuous longitudinal deformations on sheet metal with practically any longitudinal spacing between the deformed portions.

A further object of the invention is to provide a mill stand which makes it possible to control the length of the portions which are longitudinally deformed on the sheet metal.

A still further object of the invention is to provide a mill stand which makes it possible to manufacture sheet metal articles with constant longitudinal spacings between the longitudinally deformed portions.

SUMMARY OF THE INVENTION

These and other objects of the invention are attained by a mill stand for forming discontinuous longitudinal deformations on sheet metal, and said mill stand comprising a frame member with forming rolls having congruent circumferential forming elements, a power cylinder connected with one of the forming rolls for a vertically reverse motion of said forming roll, a system for feeding a working medium to the power cylinder, including means for controlling the power cylinder and a master device interacting with the means for controlling the power cylinder and, the master device being operatively connected with one of the forming rolls.

The operative connection of the master device with one of the forming rolls provides a constant longitudinal spacing between longitudinally deformed portions on the sheet metal, regardless of the forming roll rotation velocity.

In addition, said connection makes it possible to change longitudinal spacings between longitudinally deformed portions by a given value, when the mill stand is operated or stopped.

It is advantageous to make the master device in the form of a cam mechanism and the means for conrolling the power cylinder in the form of a slide valve. This being the case, the cam is intended to act with its peripheral surface through a pusher upon the valve actuating element. Such an arrangement of the master device simplifies the mill stand structure and improves the power cylinder response and, consequently, reliably provides for uniform lengths the desired longitudinal spacings between longitudinally deformed portions on the sheet metal.

The cam of the cam mechanism may be directly mounted on the shaft of one of the forming rolls.

It is advisable to have the cam mechanism operatively connected through a transmission mechanism with one of the forming rolls so that the power shaft of the transmission mechanism is coupled with one of the forming rolls and the driven shaft thereof is coupled with the cam of the cam mechanism for adjusting the longitudinal spacing between the longitudinally deformed portions on the sheet metal through an adjustment of the cam rotation velocity.

The adjustment of the cam rotation velocity makes it possible to proportionally change the length of the flat and deformed portions on the sheet metal.

It is recommended that the master device be made in the form of an automatic control system comprising a tachogenerator coupled with the shaft of one of the the forming rolls, an amplifier and a time relay, all electrically series-connected therebetween, the means for controlling the power cylinder being made in the form of a slide valve with an electromagnet electrically connected with said time relay.

BRIEF DESCRIPTION OF THE DRAWINGS

Figure 3:
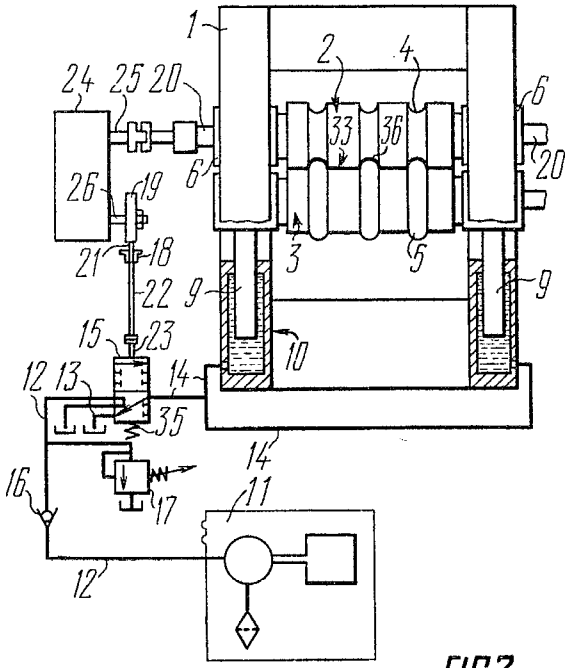
FIG. 3 is an end elevational view of the die components of FIG. 1 shown in the closed position thereof and includes the illustration of a workpiece operatively disposed therebetween.
Figure 5:
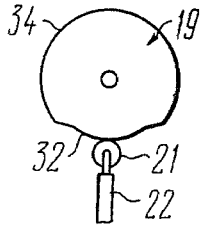
Figure 6:
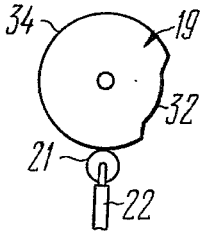
Figure 7:
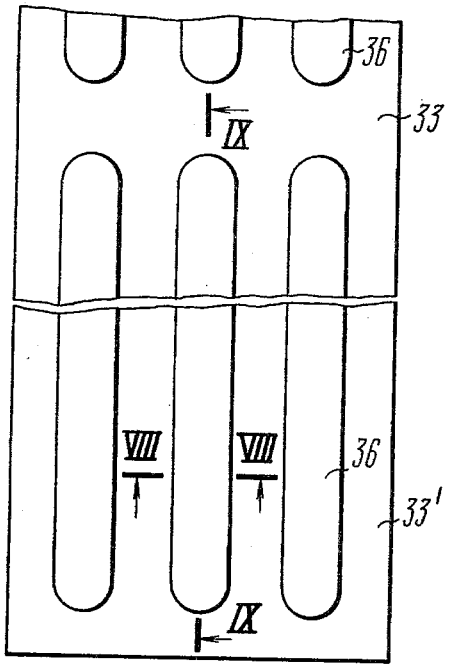
Figure 8:
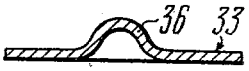
Figure 9:
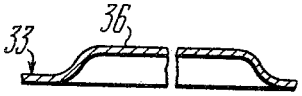

The invention will become more apparent from the following detailed description of the preferred embodiments thereof, particularly when taken in conjunction with the accompanying drawings wherein similar elements are denoted by the same reference numerals and in which:

FIG. 1 is a schematic view of our novel mill stand for forming discontinuous longitudinal deformations on sheet metal, and wherein a master device in the form of a cam mechanism whose cam is mounted on the shaft of a forming roll is also illustrated therein;

FIG. 2 is a view taken along the arrow A of FIG. 1 illustrating a position of the roll carriages in vertical guides;

FIG. 3 is a schematic view, similar to that of FIG. 1, but of another embodiment of the invention wherein one of the forming rolls is connected with two hydraulic cylinders and the other forming roll is connected with the cam mechanism through a transmission mechanism;

FIG. 4 is a further of an additional embodiment of the invention, wherein a master device is made in the form of an automatic control system;

FIG. 5 a fragmentary view illustrating the cam at the instant the surface of the cam recess comes into contact with the pusher roller, when the forming rolls are separated and the process of longitudinally deforming sheet metal is stopped;

FIG. 6 is another fragmentary view showing the cam at the instant the surface of the cam projection comes into contact with the pusher roller, when the forming rolls are brought together to longitudinally deform the sheet metal;

FIG. 7 is a fragmentary plan view of an article manufactured by means of forming discontinuous longitudinal deformations on a sheet metal;

FIG. 8 is a cross-sectional view taken along the line VIII—VIII of FIG. 7; and FIG. 9 is a cross-sectional view taken along the line IX—IX of FIG. 7.

DESCRIPTION OF THE PREFERRED EMBODIMENTS

A mill stand for forming discontinuous longitudinal deformations on sheet metal comprises a frame member 1 (FIG. 1) with forming rolls 2 and 3 mounted thereon. The forming rolls 2 and 3 are made with circumferential congruent forming elements 4 and 5.

The forming roll 3 is secured in carriages 6 mounted for a vertical reverse motion in upstanding guides 7 (FIG. 2) provided in the frame member 1. The carriages 6 (FIGS. 1 ane 2) of the forming roll 3 are mounted on a traverse 8 which is connected with a plunger 9 of a power cylinder 10.

The power cylinder 10 is included into a system for feeding a working medium thereto. The working medium may be air or a liquid, and the above system may either be of the pneumatic or hydraulic type. Therefore, the power cylinder may be an air or liquid-operated cylinder. The feeding system in the embodiments of the invention herein described is taken to be a hydraulic system and respectively the power cylinder is a hydraulic cylinder 10.

The hydraulic system includes a pumping station 11, a system of pipes 12, 13 and 14, a means 15 in the form of a slide valve for controlling the hydraulic cylinder 10, a return valve 16 and a safety valve 17.

For supplying a control signal to the hydraulic cylinder 10 for starting or stopping the sheet metal deformation, the mill stand is further provided with a master device 18.

According to the invention, the master device is operatively connected with the forming roll 2 for impressing longitudinal deformations with flat longitudinal spacings (intervals) of finite length therebetween upon the continuous sheet metal which is fed into the stand in the form of a strip unwinding from a coil (not shown).

According to the embodiments of the invention, the master device is made in the form of a cam mechanism 18 with a cam 19.

In one case, the cam 19 (FIG. 1) is mounted directly on a shaft 20 of the forming roll 2 and continuously pressed into contact with a roller 21 which is mounted at the upper end of a pusher 22. The pusher 22 is connected with an acutating element 23 of the slide valve 15.

In another case, the cam 19 (FIG. 3) of the cam mechanism 18 is connected with the forming roll 2 through a transmission mechanism 24. A power shaft 25 of the transmssion mechanism 24 is connected with the forming roll 2, and a driven shaft 26 thereof supports the cam 19. The transmission mechanism 24 may be of any suitable speed variator or reduction gear.

According to a still further embodiment of the invention, the master device (FIG. 4) is made as an automatic control system 27. The automatic control system 27 comprises a tachogenerator 28 connected with the shaft 20 of the forming roll 2, an amplifier 29 and a time relay 30, all electrically series-connected therebetween. The slide valve 15 is provided with an electromagnet 31 which is electrically connected with the time relay 30.

The mill stand for forming discontinuous longitudinal deformations on a sheet metal operates as follows.

In the initial position, the forming rolls 2 and 3 (FIG. 1) are spaced apart. That is, the traverse 8 is lowered and the forming roll 3 is separated from the forming roll 2. When the forming rolls 2 and 3 are disposed as mentioned above, the cam 19 (FIG. 5) is in such a position that a surface 32 of a recess thereof is brought into contact with the roller 21 of the pusher 22.

The leading end of a metal strip 33 (FIG. 2), wound into a coil (not shown), is fed into the clearance between the forming rolls 2 and 3. Then the drive (not shown) is energized to rotate the forming rolls 2 and 3.

When the forming rolls 2, 3 are rotated, the cam 19 (FIG. 6) runs with a surface 34 of a projection upon the roller 21 of the pusher 22. The pusher 22 (FIG. 1) displaces downwardly the valve actuating element 23 of the slide valve 15.

The valve actuating element 23 opens the inlet opening (not shown) of the slide valve 15, and the working liquid is fed from the pumping station 11 through the pipes 12 and 14 into the interior of the hydraulic cylinder 10. The plunger 9 of the hydraulic cylinder 10 displaces the traverse 8 upwardly and thereby brings the forming rolls 2 and 3 together. The metal strip 33 placed between the rolls 2 and 3 (FIG. 2) is gripped by the latter and drawn into the mill stand.

When the cam 19 runs with the surface 32 of the recess upon the roller 21 of the pusher 22, the valve actuating element 23 is displaced upwardly under the action of a spring 35 to communicate the pipes 13 and 14. The working liquid is discharged from the hydraulic cylinder 10 through the pipes 13 and 14.

When the working liquid is discharged from the interior of the hydraulic cylinder 10, the traverse 8 with the forming roll 3 are lowered by gravity, i.e. the forming rolls 2 and 3 are separated.

The metal strip 33 is subsequently transported by the rolls of another stand (not shown) installed further down stream of the metal strip travel. Thus, a metal strip portion 33 remains flat. The lengths of deformed portions 36 and flat portions 33' on the metal strip 33 depend respectively upon the lengths of the projection and the recess of the cam 19.

The cam 19 (FIG. 6) again runs with the surface 34 of the projection upon the roll 21 of the pusher 22 and the discontinuous longitudinal deformation cycle is repeated.

According to one of the embodiments of the invention, the rotation velocity of the cam 19 (FIG. 3) is adjusted and pre-set by the transmission mechanism 24. By adjusting the rotation velocity of the cam 19, it is possible to proportionally increase or decrease the lengths of the deformed portions 36 and the flat portions 33' on the metal strip 33.

According to another embodiment of the invention, the mill stand (FIG. 4) operates as follows.

The leading end of the metal strip 33 is placed between the forming rolls 2 and 3.

When the drive (not shown) adapted to rotate the forming rolls 2 and 3 is energized, the time relay 30 produces a signal which is fed to the electromagnet 31 of the slide valve 15. The valve actuating element 23 comes into action and the working liquid is fed through the pipe 14 into the hydraulic cylinder 10. The plunger 9 of the hydraulic cylinder 10 moves the traverse 8 together with the forming roll 3 upwards and thereby brings the forming rolls 2, 3 together to grip the metal strip 33 therebetween. The metal strip 33 is drawn by the rolls 2 and 3, and the forming elements 4, 5 thereof impress longitudinal deformations upon the metal strip 33. When the longitudinally deformed portions 36 of a predetermined length are formed on the metal strip 33, the time relay 30 cuts off the signal supply, and the valve actuating element 23 is returned to its initial position under the action of the spring 35 to provide discharging the hydraulic cylinder 10. As a result, the forming roll 3 is lowered by gravity. The metal strip 33 is continuously fed into the stand so that the following longitudinally deformed portions 36 (corrugations) are formed on the metal strip 33.

When the forming rolls 2, 3 are rotated at a given constant velocity, the tachogenerator 28 produces a signal of a constant magnitude. The signal, when passing through the amplifier 29, produces no correcting signal. When the rotation velocity of the forming rolls 2, 3 is changed, a signal variable in magnitude from the tachogenerator 28 is fed to the amplifier 29 where it is amplified up to a magnitude sufficient to have an effect on the control signal from the time relay 30.

The correcting signal phase and magnitude are changed depending on the velocity and the rotation direction of the forming roll 2.

Then the correcting signal is phase-added to the control signal from the time relay 30.

As a result, the duration of a signal fed to the electromagnet 31 of the slide valve 15 is increasingly or decreasingly changed, and the duration of action of the forming rolls 2 and 3 upon the metal strip 33 is consequently increased or decreased defining the lengths of the deformed portions 36 and the flat portions 33. Thus, the lengths of the deformed portions 36 and the flat portions 33' remain unchanged and independent of rotation velocity fluctuations of the forming rolls 2 and 3.

With an automatic control system, the mill stand of the present invention provides a simple and timesaving way for changing spacings between portions to be deformed 36 and kept flat 33' on the metal strip 33.

Thus, the mill stand of the present invention permits the formation of discontinuous longitudinal deformations on a continuous fed metal strip thereto, thereby enhancing the efficiency of the operation and, in addition, making it possible to broaden the standard size limits of metal strip articles with longitudinally extending deformed portions (corrugations) denoted by the reference numeral 36.

While particular embodiments of the invention have been shown and described, various modifications thereof will be apparent to those skilled in the art and therefore it is not intended that the invention be limited to the disclosed embodiments or to the details thereof and it will, of course, be understood that various changes and modifications may be made to the invention without departing from the scope of the invention as set forth the following claims.

What is claimed is:

1. A mill stand for forming discontinuous longitudinal deformations on continuous sheet metal uninterruptedly fed to said mill stand, comprising:

a frame member;

forming rolls, having congruent circumferential forming elements, mounted on said frame member in such a way that one of the forming rolls is adapted for movement toward and away from said other forming rolls;

a power cylinder being connected with said forming roll adapted for movement;

a system for feeding a working medium to said power cylinder including means for controlling said power cylinder; and a master device operatively connected with one of said forming rolls and interacting with said means for controlling said power cylinder for periodically bringing together said forming rolls, thereby discontinuously forming longitudinal deformations on said sheet metal of generally any length without the need to change said forming rolls.

2. A mill stand for forming discontinuous longitudinal deformations on continuous sheet metal uninterruptedly fed to said mill stand, comprising:

a frame member;

forming rolls, having congruent circumferential forming elements, mounted on said frame member in such a way that one of the forming rolls is adapted for movement toward and away from other said forming roll;

a hydraulic system including a hydraulic cylinder and a slide valve for controlling said hydraulic cylinder, the hydraulic cylinder being connected with said forming roll adapted for movement;

a cam mechanism having a cam operatively connected with one of said forming rolls and interacting with the slide valve controlling the hydraulic cylinder for periodically bringing together said forming rolls, thereby discontinuously forming longitudinal deformations on said sheet metal of generally any length without the need to change said forming rolls.

3. A mill stand according to claim 2, including a transmission mechanism having a power shaft and a driven shaft, said power shaft being connected with one of said forming rolls, and the cam of said cam mechanism being set on said driven shaft of said transmission mechanism for regulating the speed of rotation of said cam and for adjusting the length of the longitudinally deformed portions and the flat portions therebetween of said sheet metal.

4. A mill stand according to claim 2, wherein said cam of said cam mechanism is secured substantially to the end of one of said forming rolls.

5. A mill stand for forming discontinuous longitudinal deformations on continuous sheet metal uninterruptedly fed to said mill stand comprising:

a frame member;

forming rolls, having congruent circumferential forming elements, mounted on said frame member in such a way that one of the forming rolls is adapted for movement toward and away from said other forming roll;

a hydraulic system including a hydraulic cylinder and a slide valve with an electromagnet for controlling said hydraulic cylinder, the hydraulic cylinder being connected with said forming roll adapted for movement;

an automatic control system including a tachogenerator connected with one of said forming rolls, an amplifier and a time relay, the tachogenerator, the amplifier, the time relay and the slide valve eletromagnet being electrically series-connected therebetween for periodically bringing together said forming rolls, thereby discontinuously forming longitudinal deformations on said sheet metal of generally any desired length without the need to change said forming rolls.

* * * * *